United States Patent [19]

Carmel

[11] 4,338,064

[45] Jul. 6, 1982

[54] CLUTCH ASSEMBLY

[76] Inventor: Fred Carmel, 2710 Merlin Pl., Oceanside, Calif. 92054

[21] Appl. No.: 135,728

[22] Filed: Mar. 31, 1980

[51] Int. Cl.[3] ..... B63H 23/30; F16D 7/02

[52] U.S. Cl. ..... 416/134 R; 416/169 R; 464/41

[58] Field of Search ..... 416/134 R, 169 R; 64/30 D

[56] References Cited

U.S. PATENT DOCUMENTS

| | | | |
|---|---|---|---|
| 2,235,605 | 3/1941 | Bugatti | 416/134 R |
| 2,333,166 | 11/1943 | Fraser | 416/134 R |
| 2,363,469 | 11/1944 | Goldschmidt | 416/134 R |
| 2,469,116 | 5/1949 | Kiekhaefer | 416/134 R X |
| 2,543,396 | 2/1951 | Wolff | 416/169 R X |
| 2,962,312 | 11/1960 | Wanner | 416/134 R X |
| 2,993,544 | 7/1961 | Carlson | 416/134 R |
| 3,045,763 | 7/1962 | Perrott | 416/134 R X |
| 3,047,074 | 7/1962 | Rielag | 416/134 R X |
| 3,096,106 | 7/1963 | Wanner | 416/169 R X |
| 3,748,061 | 7/1973 | Henrich | 416/169 X |
| 4,041,730 | 8/1977 | Kress | 64/30 D |

*Primary Examiner*—Everette A. Powell, Jr.
*Attorney, Agent, or Firm*—Frank D. Gilliam

[57] ABSTRACT

An improved clutch assembly for use between a propeller and a propeller drive shaft. A bushing preferably in the form of an internally splined tube is adapted to fit over the splined output end of a drive shaft. One or more longitudinally raised ridges extend along a portion of the tube exterior. At least one radial flange extends at least partially around the tube exterior, spaced from one end of the tube. At least one elastomeric cushion, having the configuration of a radial tube section, engages the exterior wall of the tube between ridges. The diameter of this assembly is such as to allow insertion into a propeller bore with a tight friction fit between the cushion and the interior wall of the bore.

7 Claims, 3 Drawing Figures

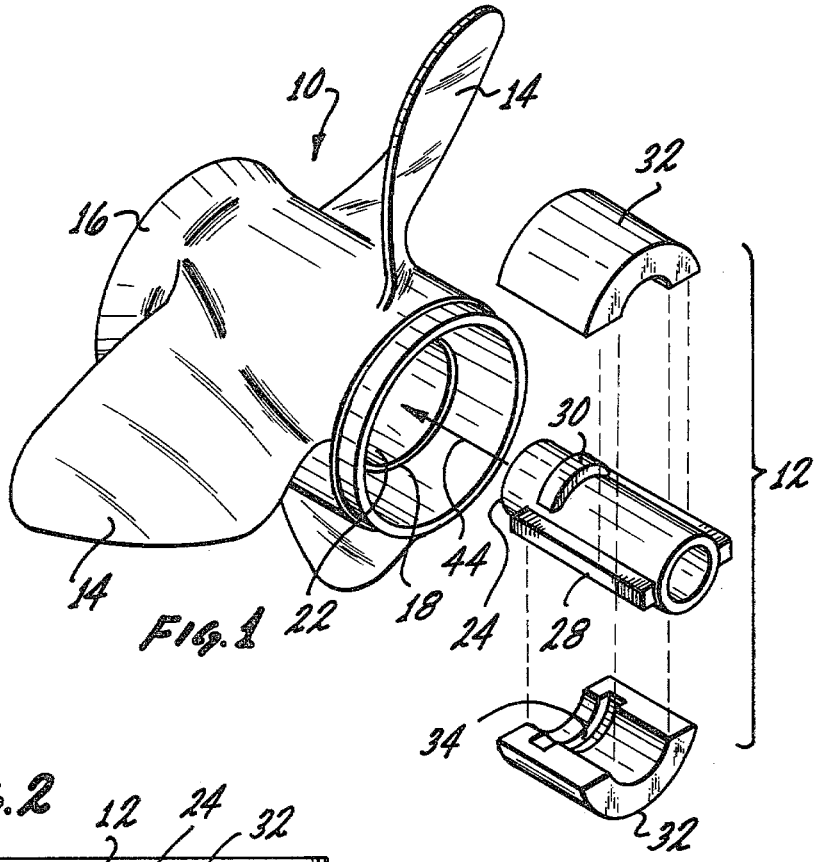
Fig. 1
Fig. 2
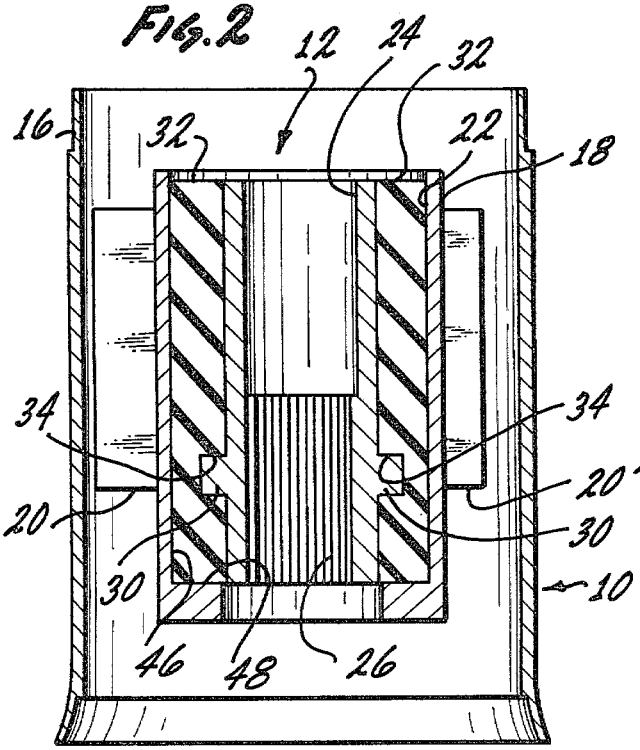
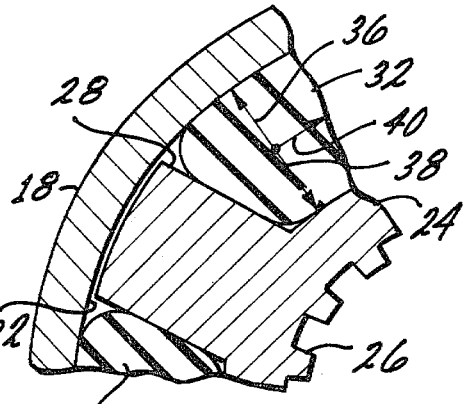
Fig. 3

CLUTCH ASSEMBLY

BACKGROUND OF THE INVENTION

This invention relates in general to clutches and, more specifically, to friction for use in driving propellers and the like.

Rotating propellers, such as are used with boats, air-moving fans, model aircraft and the like, are generally driven by a motor through a drive shaft. Sometimes the propeller strikes an object or becomes entangled in material such as seaweed, suddenly and severely increasing resistance to rotation. Where the drive shaft is rigidly fastened to the propeller, severe damage to the propeller, drive shaft, bearings, motor, etc., may result.

In order to prevent or alleviate such damage, a variety of devices, such as clutches and shear pins, have been used between drive shafts and propellers to disengage them in the event of a sudden increase in resistance to propeller rotation.

Shear pins and the like usually include a rigid fastener between drive shaft and propeller. The fracture resistance of the fastener is selected to be sufficiently low so as to break before damage to other drive components occurs. While generally effective in preventing damage, these devices totally disable the propeller until repairs, including replacement of the fastener, can be made. Often the repairs are costly, time-consuming and require special equipment unavailable in the field.

A variety of clutch assemblies have been designed to allow direct drive under normal conditions and relative slippage between drive shaft and propeller under high rotation resistance conditions. Many such clutches utilize a tube of rubber-like material bonded or vulcanized around an internally splined drive shaft. This assembly is forced into a propeller bore which has an internal diameter slightly less than the free outside diameter of the rubber tube, so as to assure sufficient pressure between tube and bore to provide drive friction. While such clutches are often effective, any delamination of rubber tube and splined tube will permit excessive propeller slippage and require disassembly of the drive assembly and replacement of the rubber tube/splined tube combination. Also, the diameter of the rubber tube can be only slightly larger than the bore to permit installation without damaging the inter-tube bond. Further, when the rubber tube exterior becomes worn, the entire assembly of splined tube and rubber tube must be replaced.

Instead of bonding the splined tube to the rubber tube, clutches has been designed with longitudinal ridges or keys extending out from the splined tube into corresponding recesses in the rubber tube to lock the tubes together during rotation. Typical of such clutches is that described in U.S. Pat. No. 2,962,312. These clutches, however, leave the rubber tube free to slide longitudinally along the splined tube in at least one direction, making installation and/or removal difficult where the rubber tube is oversize to improve friction characteristics.

With high motor power, clutches must be able to resist slipping during acceleration and other moderately varying rotational forces while promptly disengaging when a predetermined force level is exceeded. Prior rubber tube clutches tend to slip excessively, since the maximum friction between bore and rubber tube is limited by limits on compression of the rubber tube during installation.

Thus, there is a continuing need for improved propeller drive clutches of improved simplicity, reliability and effectiveness.

OBJECTS OF THE INVENTION

It is, therefore, an object of this invention to provide a propeller drive clutch assembly overcoming the above-noted problems.

Another object of this invention is to provide a propeller drive clutch assembly capable of accommodating higher drive forces and drive force variations.

A further object of this invention is to provide a propeller drive clutch assembly having increased ease and convenience of installation.

Yet another object of this invention is to provide a propeller drive clutch assembly capable of being repaired at low cost and requiring replacement of fewer parts.

SUMMARY OF THE INVENTION

The above objects, and others, are accomplished by a friction clutch assembly for use between a drive shaft and a propeller or the like. A tube or bushing having an internal means for connecting to the output end of a drive shaft has a generally cylindrical outer surface with at least one longitudinal upstanding ridge running at least partially therealong. A radial flange extends outwardly from said surface to a height less than that of said ridge. This flange is located near, but spaced from, one end of said bushing. At least one elastomeric cushion, in the form of a segment of a tube, is positioned against the bushing surface with longitudinal edges in contact with said at least one ridge. An internal radial groove in said cushion mates with said radial flange. This assembly is adapted to being forced into the bore of a propeller, using a conventional installation cone to reduce by compression the diameter of the cushion to the diameter of the bore, since the outer diameter of the cushion is preferably greater than the bore internal diameter. The at least one longitudinal ridge has a height such that when installed in the bore, the ridges just clear the bore surface.

BRIEF DESCRIPTION OF THE DRAWING

Details of the invention, and of a preferred embodiment thereof, will be further understood upon reference to the drawing, wherein:

FIG. 1 is a schematic exploded perspective view showing the drive clutch assembly of this invention and a propeller of the type with which the clutch may be used;

FIG. 2 is a section view taken along the longitudinal axis of the clutch assembly as installed in a propeller; and FIG. 3 is a detail end view, illustrating the forces involved when the clutch is in operation.

DETAILED DESCRIPTION OF THE INVENTION

Referring now to FIGS. 1 and 2, there is seen a conventional marine-type propeller 10 and a drive clutch assembly 12. While propeller 10 is the sort used on a ship or boat, any other suitable propeller, such as an airplane or model airplane propeller, an air-moving fan blade, a pump impeller, etc., may be used with this novel clutch assembly.

Propeller 10 consists of blades 14 mounted on an outer tube 16. An inner tube 18 is mounted within outer tube 16 by a plurality of brackets 20 (seen in FIG. 2). A bore 22 within inner tube 18 is sized to receive clutch assembly 12. Suitable retaining rings, end cones, etc. (not shown) may be attached to propeller 10 after installation of the clutch assembly and mounting of the assembly on a drive shaft.

Clutch assembly 12 consists of a rigid splined tube or bushing 24 having splines 26 (seen in FIGS. 2 and 3) on a portion of the interior adapted to engage corresponding splines on a conventional drive shaft (not shown). One or more longitudinal upstanding ridges 28 are secured to the outer wall of splined bushing 24. While any suitable number of ridges 28 may be used, two or three equally spaced ridges 28 are preferred for optimum results and balanced forces. The height of ridges 28 is such that they are out of contact with bore 22 when splined bushing 24 is centered within bore 22. Preferrably, the clearance between ridges 28 and bore 22 is from about 0.010 inch to 0.020 inch. Spaced from one end of splined bushing 24 are one or more upstanding flanges 30. Each flange 30 extends between adjacent ridges 28. Preferrably, flanges 30 are located from about 0.9 to 1.5 inches from the adjacent end of tube 24.

At least one elastomeric cushion 32 is provided, having the configuration of a longitudinal segment of a tube, adapted and sized to fit against the outer wall of bushing 24. In the embodiment shown, two cushions 32 are provided since two ridges 28 are mounted on bushing 24. The number of ridges 28 and cushions 32 will always be the same. A groove 34 is provided on the inner surface of each cushion 32, sized to mate with each flange 30. Cushion 32 may be formed from any suitable elastomeric material, such as natural and synthetic rubbers. The length of cushions 32 will ordinarily be the same as the length of splined bushing 24, as illustrated in FIG. 2. The thickness of each cushion 32 is such that the overall diameter of clutch assembly 12 with cushions 32 in place will be somewhat greater than the diameter of bore 22, so as to provide a tight, compressed fit when clutch assembly 12 is inserted into bore 22. For best results, the diameter of clutch assembly 12, across cushions 32, exceeds the inside diameter of bore 22 by about 10 to 30 percent.

Flanges 30 may have any suitable height which corresponds to the depth of grooves 34. As discussed further below, the grooves must have sufficient depth to hold firmly on flanges 30 during clutch assembly insertion, but must not be so deep as to permit the cushion portion below grooves 34 to tear during insertion. For best results, the depth of grooves 34 should be from about 30 to 60 percent of the thickness of cushion 32.

FIG. 3 illustrates the forces applied to and by cushion 32 when clutch assembly 12 is installed in bore 22. Arrows 36 and 38 illustrate the equal and opposite forces caused by compression of cushion 32 between bushing 24 and bore 22, with the assembly either at rest or in normal operation. Arrow 40 illustrates the tangentially applied force which causes the propeller to turn in a clockwise direction and also causes the cushion 32 to slip against bore 22 when the rapidly rotating propeller 10 strikes an object. At the moment rotating propeller 10 strikes an object, becomes tangled in seaweed, etc., the force shown by arrow 40 increases due to induced relative motion between ridge 28 and propeller 10 as propeller 10 is slowed and ridge 28 continues to drive clockwise. Rubber cushion 32 deforms, bulging slightly as ridge 28 in effect pushes more strongly thereagainst. The compressive forces are radial and add to the forces shown by arrows 36 and 38, increasing the pressure against the inside of bore 22 and increasing momentarily the frictional resistance to slipping. If the impact or drag was not great, this increase in frictional forces is sufficient to keep propeller 10 rotating with the clutch assembly and drive shaft. With greater impacts, at some time the forces illustrated by arrows 36 and 38 are exceeded by the impact force shown by arrow 40 and propeller 10 stops with the clutch assembly 12, continuing to rotate with cushions 32 slipping against bore 22. Once the retarding force is removed, the forces shown by arrows 36 and 38 again exceed the slippage inducing forces (arrow 40) and the clutch reengages.

This arrangement, using ridges 28 and divided cushions 32, permits the clutch to remain engaged during minor impacts, boat acceleration, etc., which would cause a conventional tubular cushion to slip.

The various features of this invention also make installation of the assembled clutch 12 into bore 22 easier and eliminate damage during installation.

After cushions 32 are placed on splined bushing 24, the resulting clutch assembly 12 is pressed into bore 22 as indicated by arrow 44. Since the diameter of the clutch through cushions 32 is greater than the inner diameter of bore 22, insertion could be quite difficult. However, the divided cushion 32 can more easily stretch in one direction (parallel to arrow 44) than would be the case with a single tubular cushion, which while stretching lengthwise would also tend to tighten on the core, preventing further lengthwise stretching. Also, with a tubular cushion over a bushing with simple ridges or keys, the cushion would tend to slip along the bushing surface during installation. With the device of this invention, flanges 30 cooperate with cushion grooves 34 to hold cushions 32 in place during installation. Also, because of the increase in friction forces upon minor impact (as described above), the device can use slightly softer, more easily compressed cushions or slightly smaller diameter cushions and still achieve equal impact resistance to clutches using harder tubular cushions. The softer and/or thinner cushions are, of course, easier to compress into bore 22 during installation.

The preferred sequence of installation steps permits easy, rapid installation with little risk or propeller damage. First, a conventional installation cone (not shown) having an inside diameter at the small end equal to or slightly smaller than bore 22 and at the other (large) end greater than the uncompressed diameter of clutch assembly 12 with cushions 32 in place, is placed with the small end aligned with bore 22. The inner surface of bore 22, the inside of the installation cone and the outer surface of cushion 32 are lubricated with a water soluble lubricant, such as corn syrup. The assembly is placed in any reasonably square press to drive the assembly 12 into bore 22. Pressure is applied only to the outer end of splined bushing 24 so as not to confine cushion 32 adjacent thereto. Pressure is applied until the clutch assembly is fully inserted into bore 22 as seen in FIG. 2. Also, a wall 48 is preferrably provided to prevent over-insertion of clutch assembly 12. Once installation of the clutch is completed, the assembly may be mounted on a splined drive shaft (not shown) and any desired rings range, locking nuts, tail cones, etc. may be installed.

Other applications, variations and ramifications of this invention will occur to those skilled in the art upon reading this disclosure. These are intended to be included within the scope of this invention, as defined in the appended claims.

What is claimed is:

1. In a propeller mounting assembly comprising a drive shaft, a drive clutch assembly engaging the drive shaft and a propeller having a bore surrounding said clutch assembly, the improvement wherein said clutch assembly comprises:

(a) a generally tubular rigid bushing having an interior adapted to locking engagement with said drive shaft;

(b) at least one outwardly extending longitudinal ridge on said bushing;

(c) at least one radial flange on said bushing spaced from the bushing ends;

(d) the diameter of said flange being (substantially) less than the diameter of said bore; and (e) at least one elastomeric cushion having the general configuration of a tube segment, said at least one cushion having a radial outer surface area less than the radial inner surface area of said bore;

(f) said cushion being sized to fit snugly against said bushing with longitudinal cushion edges having only an abutting engagement with said at least one ridge;

(g) said cushion including an internal radial groove adapted to mate with said flange;

(h) the diameter of said assembly being somewhat greater than the internal diameter of said bore;

(i) whereby the outer surface of said cushion is in tight frictional contact with said bore when said assembly is installed in said bore.

2. The improvement according to claim 1 wherein said at least one ridge is a plurality of said ridges substantially equally spaced around said bushing, and said at least one cushion is a number of cushions equal to the number of ridges, with each cushion adapted to fit between adjacent ridges.

3. The improvement according to claim 1 wherein the diameter of said assembly of bushing and cushions, prior to installation, exceeds the diameter of said bore by from about 10 to 30 percent.

4. The improvement according to claim 1 wherein the depth of said groove and the height of said flanges are substantially equal and the depth of said grooves is from about 30 to 60 percent of the thickness of said cushion.

5. The improvement according to claim 1 wherein said flange is located from about 0.9 to 1.5 inches from the end of said bushing.

6. The improvement according to claim 1, wherein said bushing is internally splined to mesh with an external spline on the end of a drive shaft.

7. The invention as defined in claim 1 wherein said at least one outward extending longitudinal ridge is two in number, said at least one elastomeric cushion is two in number and the difference in circumferential areas between said bore and said cushion is substantially equal to the combined widths of the two outward extending longitudinal ridges.

* * * * *

UNITED STATES PATENT OFFICE

CERTIFICATE OF CORRECTION

Patent No. 4,338,064 Dated July 6, 1982

Inventor(s) FRED CARMEL

It is certified that error appears in the above-identified patent and that said Letters Patent are hereby corrected as shown below:

In claim 1, the entire line 13 should read:

"(d) the diameter of said flange being"

Signed and Sealed this

*Fifth* Day of *October 1982*

[SEAL]

*Attest:*

GERALD J. MOSSINGHOFF

*Attesting Officer* *Commissioner of Patents and Trademarks*